United States Patent [19]

Yodogawa et al.

[11] 4,160,748

[45] Jul. 10, 1979

[54] NON-LINEAR RESISTOR

[75] Inventors: Masatada Yodogawa; Susumu Miyabayashi; Yoshinari Yamashita; Takashi Yamamoto; Kohji Hayashi; Hisayoshi Ueoka, all of Tokyo, Japan

[73] Assignee: TDK Electronics Co., Ltd., Tokyo, Japan

[21] Appl. No.: 863,922

[22] Filed: Dec. 23, 1977

[30] Foreign Application Priority Data

Jan. 6, 1977 [JP] Japan ..... 52/495

[51] Int. Cl.[2] ..... H01B 1/08

[52] U.S. Cl. ..... 252/518; 252/520; 252/521; 252/519

[58] Field of Search ..... 252/518, 519, 520, 521; 106/73.2

[56] References Cited

U.S. PATENT DOCUMENTS

| | | | |
|---|---|---|---|
| 3,663,458 | 5/1972 | Masuyama et al. | 252/519 X |
| 3,670,216 | 6/1972 | Masuyama et al. | 252/521 X |
| 3,926,858 | 12/1975 | Ichinose et al. | 252/521 X |
| 3,962,144 | 6/1976 | Matsuura et al. | 252/520 X |
| 4,033,906 | 7/1977 | Nagasawa et al. | 252/519 |
| 4,038,217 | 7/1977 | Namba et al. | 252/519 X |
| 4,069,061 | 1/1978 | Nagasawa et al. | 106/73.2 |
| 4,077,915 | 3/1978 | Yodogawa et al. | 106/73.2 X |

*Primary Examiner*—Benjamin R. Padgett
*Assistant Examiner*—E. Suzanne Parr
*Attorney, Agent, or Firm*—Oblon, Fisher, Spivak, McClelland & Maier

[57] ABSTRACT

A non-linear resistor comprises a sintered body of a ceramic composition which comprises 99.93 to 50 mole % of zinc oxide as ZnO; 0.01 to 10 mole % of a specific rare earth oxide as $R_2O_3$ (R represents lanthanum, praseodymium, neodymium, samarium, europium, gadolinium, terbium, dysprosium, holmium, erbium, thulium, ytterbium or lutetium) 0.01 to 10 mole % of an alkaline earth oxide as MO (M represents calcium, strontium or barium) and 0.05 to 30 mole % of cobalt oxide as CoO.

6 Claims, No Drawings

NON-LINEAR RESISTOR

BACKGROUND OF THE INVENTION

1. Field of the Invention

The present invention relates to a ceramic composition of a non-linear resistor comprising zinc oxide, a specific rare earth oxide, a specific alkaline earth metal oxide and cobalt oxide which has high $\alpha$-value of non-linearity based on the sintered body itself.

DESCRIPTION OF PRIOR ARTS

The conventional non-linear resistors (hereinafter referring to as varistor)include silicon carbide varistors and silicon varistors. Recently, varistors comprising a main component of zinc oxide and an additive have been proposed.

The voltage-ampere characteristic of a varistor is usually shown by the equation $$I=(V/C)\alpha$$

wherein V designates a voltage applied to the varistor and I designates a current passed through the varistor and C designates a constant corresponding to the voltage when the current is passed.

The exponent $\alpha$ can be given by the equation $$\alpha=\mathrm{Log}_{10}(I_2/I_1)/\log_{10}(V_2/V_1) \quad (1)$$

wherein $V_1$ and $V_2$ respectively designate voltage under passing the current $I_1$ or $I_2$.

A resistor having $\alpha=1$ is an ohmic resistor and the non-linearity is superior when the $\alpha$-value is higher. It is usual that $\alpha$-value is desirable as high as possible. The optimum C-value is dependent upon the uses of the varistor and it is preferable to obtain a sintered body of a ceramic composition which can easily give a wide range of the C-value.

The conventional silicon carbide varistors can be obtained by sintering silicon carbide powder with a ceramic binding material. The non-linearity of the silicon carbide varistors is based on voltage dependency of contact resistance between silicon carbide grains. Accordingly, the C-value of the varistor can be controlled by varying a thickness in the direction of the current passed through the varistor. However, the non-linear exponent $\alpha$ is relatively low as 3 to 7. Moreover, it is necessary to sinter it in a non-oxidizing atmosphere. On the other hand, the non-linearity of the silicon varistor is dependent upon the p-n junction of silicon whereby it is impossible to control the C-value in a wide range.

Varistors comprising a sintered body of ceramic composition comprising a main component of zinc oxide and the other additive of bismuth, antimony, manganese, cobalt and chromium have been developed.

The non-linearity of said varistor is based on the sintered body itself and is remarkably high, advantageously. On the other hand, a volatile component which is vaporizable at high temperature required for sintering the mixture for the varistor, such as bismuth is included whereby it is difficult to sinter the mixture to form varistors having the same characteristics in mass production without substantial loss.

SUMMARY OF THE INVENTION

It is an object of the present invention to provide a non-linear resistor of a varistor which has not the above-mentioned disadvantage and has the following advantages.

It is the other object of the present invention to provide a non-linear resistor of a varistor wherein the non-linearity is dependent upon the sintered body itself and the C-value can be easily controlled by varying thickness of the sintered body in the direction of passing the current without varying $\alpha$-value; the non-linearity is remarkably high as the $\alpha$-value is high as 45 to 60 and a large current which could not passed through a Zener diode can be passed.

It is the other object of the present invention to provide a non-linear resistor of a varistor which does not contain a volatile component which is vaporizable in the sintering step whereby it is easily sintered without substantial loss in a mass production.

The foregoing and other objects of the present invention have been attained by providing a non-linear resistor comprising a sintered body of a ceramic composition which comprises 99.93 to 50 mole % of zinc oxide as ZnO; 0.01 to 10 mole % of a specific rare earth oxide as $R_2O_3$ (R represents lanthanum, praseodymium, neodymium, samarium, europium, gadolinium, terbium, dysprosium, holmium, erbium, thulium, ytterbium or lutetium) 0.01 to 10 mole % of an alkaline earth oxide as MO (M represents calcium, strontium or barium) and 0.05 to 30 mole % of cobalt oxide as CoO.

DETAILED DESCRIPTION OF THE PREFERRED EMBODIMENTS

The sintered body of the ceramic composition which imparts remarkably excellent non-linearity comprises 99.75 to 70 mole % of zinc oxide as ZnO, 0.05 to 5 mole % of the specific rare earth oxide as $R_2O_3$; 0.1 to 5 mole % of the specific alkaline earth metal oxide as MO and 0.1 to 20 mole % of cobalt oxide as CoO.

As the preferable embodiment, the ceramic composition of the sintered body comprises 99.74 to 69 mole % of zinc oxide as ZnO; 0.05 to 5 mole % of the specific rare earth oxide as $R_2O_3$ (R is defined above); 0.1 to 5 mole % of the specific alkaline earth metal oxide as MO (M is defined above); 0.1 to 20 mole % of cobalt oxide as CoO and 0.01 to 1 mole % of a specific tetravalent element oxide as $M'O_2$ (M' represents silicon, germanium, tin, titanium, zirconium hafnium, or cerium).

The ceramic composition of the sintered body which impart further superior non-linearity comprises 99.24 to 80.8 mole % of zinc oxide as ZnO, 0.05 to 2 mole % of the specific rare earth oxide as $R_2O_3$, 0.5 to 2 mole % of the specific alkaline earth metal oxide as MO, 0.2 to 15 mole % of cobalt oxide as CoO and 0.01 to 0.2 mole % of the specific tetravalent element oxide as $M'O_2$.

The optimum amount of the specific tetravalent element oxide is dependent upon the amount of cobalt oxide and it is preferable to be a molar ratio of $M'O_2$/-CoO of 0.002 to 0.1.

As the other preferable embodiment, the ceramic composition of the sintered body comprises 99.74 to 69 mole % of zinc oxide as ZnO; 0.05 to 5 mole % of the specific rare earth oxide as $R_2O_3$ (R is defined above); 0.1 to 5 mole % of the specific alkaline earth metal oxide as MO (M is defined above); 0.1 to 20 mole % of cobalt oxide as CoO and 0.01 to 1 mole % of a specific trivalent element oxide as $M''_2O_3$ (M'' represents boron, aluminum, gallium, indium, yttrium, chromium, iron and antimony).

It is especially preferable to combine the zinc oxide component, the rare earth oxide component of $Nd_2O_3$, $Sm_2O_3$, $Pr_2O_3$, $Dy_2O_3$, $La_2O_3$ the alkaline earth metal oxide component of BaO or SrO and the cobalt oxide component optionally, the trivalent element oxide of $Al_2O_3$, $Ga_2O_3$, $In_2O_3$ or $Y_2O_3$ or the tetravalent element oxide of $TiO_2$ or $SnO_2$.

The ceramic composition of the sintered body which impart further superior non-linearity comprises 99.24 to 80.8 mole % of zinc oxide as ZnO; 0.05 to 2 mole % of the specific rare earth oxide as $R_2O_3$; 0.5 to 2 mole % of the specific alkaline earth metal oxide as MO; 0.2 to 15 mole % of cobalt oxide as CoO and 0.01 to 0.2 mole % of the specific trivalent element oxide as $M''_2O_3$.

The optimum amount of the specific trivalent element oxide is dependent upon the amount of cobalt oxide and it is preferable to be a molar ratio of $M''_2O_3$/CoO of 0.002 to 0.1.

The sintered body of zinc oxide is a n type semiconductor having relatively low resistance. However, in the sintered body of the above-mentioned oxides, it is observed that remarkably thin insulation layer of the specific rare earth oxide, the specific alkaline earth metal oxide, cobalt oxide and the trivalent element oxide or the tetravalent element oxide is formed at the boundary of zinc oxide grains. It is considered that the excellent non-linearity and the life characteristic of the varistor of the ceramic composition are based on the excellent characteristic of the insulation layer of the oxides as potential barrier. The trivalent element oxide or the tetravalent element oxide is useful as the component of the insulation layer and also is useful to further improve the non-linearity by dissolving into the zinc oxide crystalline phase as a solid solution to remarkably decrease the resistance of the phase.

It is preferable that the resistance of the zinc oxide crystalline phase is low as far as possible for the excellent non-linearity as the equation (1) of the $\alpha$-value. The denominator of the equation is preferably lower and the difference between $V_1$ and $V_2$ is preferably lower. Accordingly, it is preferable that the potential difference caused by the crystalline phase is lower and the resistance of the crystalline phase is lower.

The consideration of the proportional relation of the amount of cobalt oxide and the trivalent element oxide or the tetravalent oxide is dependent upon the fact that a part of cobalt oxide forms a solid solution in the zinc oxide crystalline phase to increase the resistance of the crystalline phase and enough amount of the trivalent element oxide or tetravalent element oxide for compensating the increase of the resistance is required.

The excellent non-linearity and the life characteristic can be imparted by the above-mentioned composition.

The ceramic composition for the varistor (non-linear resistor) can be prepared by the conventional processes.

In a typical process for preparing the sintered body of ceramic composition the weighed raw materials were uniformly mixed by a wet ball-mill and the mixture was dried and calcined. The temperature for the calcination is preferably in a range of 700° to 1200° C.

The calcination of the mixture is not always necessary, but it is preferable to carry out the calcination so as to decrease fluctuation of characteristics of the varistor. The calcined mixture is pulverized by a wet ball-mill and is dried and mixed with a binder to form a desirable shape. In the case of a press molding, the pressure for molding is enough to be 100 to 2000 $Kg/cm^2$.

The optimum temperature for sintering the shaped composition is dependent upon the composition and is preferably in a range of 1000° to 1450° C. The atmosphere for the sintering operation can be air, and can be also a non-oxidizing atmosphere such as nitrogen and argon to obtain high $\alpha$-value of the varistor.

An electrode can be ohmic contact or non-ohmic contact with the sintered body and can be made of silver, copper, aluminum, zinc, indium, nickel or tin. The characteristics are not substantially affected by the kind of the metal.

The electrode can be prepared by a metallizing, a vacuum metallizing, an electrolytic plating, an electroless plating, or a spraying method etc.

The raw materials for the ceramic composition of the present invention can be various forms such as oxides, carbonates, oxalates, and nitrates, which can be converted to oxides in the calcining and sintering step.

The cobalt oxide and the alkaline earth metal oxide can be added by diffusing into a sintered body without adding before the calcination.

It is possible to incorporate the other impurities or additives in the ceramic composition as far as the characteristics of the varistor are not adversely affected.

EXAMPLE 1

The raw materials for the oxides were weighted at the ratio listed in Table 1 and were mixed in a wet ball-mill for 20 hours.

The mixture was dried and polyvinyl alcohol was added as a binder and the mixture was granulated and was shaped to a disc having a diameter of 11 mm, a thickness of 1.2 mm by a press molding method.

The shaped body was sintered at 1000° C. to 1450° C.

Each electrode was connected to both sides of the sintered body and the voltage-ampere characteristics of them were measured.

The results are shown in Tables 1 to 6 wherein the C-values are shown by a unit V/mm under passing the current of 1 $mA/cm^2$ (V/mm:voltage/thickness).

Table 1

| Sample | Composition (mol %) ZnO | BaO | $Nd_2O_3$ | CoO | $\alpha$-Value | C-Value (at 1mA) |
|---|---|---|---|---|---|---|
| 1 | 98.49 | 0.01 | 0.5 | 1 | 35 | 658 |
| 2 | 98.4 | 0.1 | 0.5 | 1 | 51 | 243 |
| 3 | 97.5 | 1 | 0.5 | 1 | 60 | 220 |
| 4 | 93.5 | 5 | 0.5 | 1 | 50 | 203 |
| 5 | 88.5 | 10 | 0.5 | 1 | 34 | 182 |
| 6 | 97.99 | 1 | 0.01 | 1 | 22 | 192 |
| 7 | 97.95 | 1 | 0.05 | 1 | 51 | 215 |
| 8 | 93 | 1 | 5 | 1 | 51 | 248 |
| 9 | 88 | 1 | 10 | 1 | 36 | 691 |
| 10 | 98.45 | 1 | 0.5 | 0.05 | 31 | 186 |
| 11 | 98.4 | 1 | 0.5 | 0.1 | 50 | 207 |
| 12 | 78.5 | 1 | 0.5 | 20 | 49 | 358 |
| 13 | 68.5 | 1 | 0.5 | 30 | 34 | 625 |

Table 2

| Sample | Composition (mol %) ZnO | BaO | $Eu_2O_3$ | CoO | $\alpha$-Value | C-Value (at 1mA) |
|---|---|---|---|---|---|---|
| 14 | 98.49 | 0.01 | 0.5 | 1 | 35 | 518 |
| 15 | 98.4 | 0.1 | 0.5 | 1 | 52 | 314 |
| 16 | 97.5 | 1 | 0.5 | 1 | 60 | 282 |
| 17 | 93.5 | 5 | 0.5 | 1 | 52 | 262 |
| 18 | 88.5 | 10 | 0.5 | 1 | 36 | 217 |
| 19 | 97.99 | 1 | 0.01 | 1 | 22 | 200 |
| 20 | 97.95 | 1 | 0.05 | 1 | 51 | 250 |
| 21 | 93 | 1 | 5 | 1 | 50 | 291 |
| 22 | 88 | 1 | 10 | 1 | 38 | 556 |
| 23 | 98.45 | 1 | 0.5 | 0.05 | 31 | 214 |

Table 2-continued

| Sample | Composition (mol %) ZnO | BaO | $Eu_2O_3$ | CoO | α-Value | C-Value (at 1mA) |
|---|---|---|---|---|---|---|
| 24 | 98.4 | 1 | 0.5 | 0.1 | 50 | 248 |
| 25 | 78.5 | 1 | 0.5 | 20 | 48 | 321 |
| 26 | 68.5 | 1 | 0.5 | 30 | 38 | 568 |

Table 3

| Sample | Composition (mol %) ZnO | SrO | $Sm_2O_3$ | CoO | α-Value | C-Value (at 1mA) |
|---|---|---|---|---|---|---|
| 27 | 98.49 | 0.01 | 0.5 | 1 | 19 | 401 |
| 28 | 98.4 | 0.1 | 0.5 | 1 | 52 | 304 |
| 29 | 97.5 | 1 | 0.5 | 1 | 62 | 300 |
| 30 | 93.5 | 5 | 0.5 | 1 | 52 | 288 |
| 31 | 88.5 | 10 | 0.5 | 1 | 36 | 243 |
| 32 | 97.99 | 1 | 0.01 | 1 | 22 | 202 |
| 33 | 97.95 | 1 | 0.05 | 1 | 53 | 278 |
| 34 | 93 | 1 | 5 | 1 | 53 | 316 |
| 35 | 88 | 1 | 10 | 1 | 38 | 748 |
| 36 | 98.45 | 1 | 0.5 | 0.05 | 32 | 264 |
| 37 | 98.4 | 1 | 0.5 | 0.1 | 52 | 292 |
| 38 | 78.5 | 1 | 0.5 | 20 | 51 | 355 |
| 39 | 68.5 | 1 | 0.5 | 30 | 37 | 658 |

Table 4

| Sample | Composition (mol %) ZnO | SrO | $Gd_2O_3$ | CoO | α-Value | C-Value (at 1mA) |
|---|---|---|---|---|---|---|
| 40 | 98.49 | 0.01 | 0.5 | 1 | 33 | 512 |
| 41 | 98.4 | 0.1 | 0.5 | 1 | 50 | 360 |
| 42 | 97.5 | 1 | 0.5 | 1 | 59 | 342 |
| 43 | 93.5 | 5 | 0.5 | 1 | 49 | 318 |
| 44 | 88.5 | 10 | 0.5 | 1 | 31 | 271 |
| 45 | 97.99 | 1 | 0.01 | 1 | 22 | 202 |
| 46 | 97.95 | 1 | 0.05 | 1 | 49 | 296 |
| 47 | 93 | 1 | 5 | 1 | 49 | 362 |
| 48 | 88 | 1 | 10 | 1 | 34 | 708 |
| 49 | 98.45 | 1 | 0.5 | 0.05 | 31 | 260 |
| 50 | 98.4 | 1 | 0.5 | 0.1 | 49 | 304 |
| 51 | 78.5 | 1 | 0.5 | 20 | 47 | 366 |
| 52 | 68.5 | 1 | 0.5 | 30 | 33 | 618 |

Table 5

| Sample | Composition (mol %) ZnO | CaO | $La_2O_3$ | CoO | α-Value | C-Value (at 1mA) |
|---|---|---|---|---|---|---|
| 53 | 98.49 | 0.01 | 0.5 | 1 | 20 | 202 |
| 54 | 98.4 | 0.1 | 0.5 | 1 | 46 | 162 |
| 55 | 97.5 | 1 | 0.5 | 1 | 56 | 160 |
| 56 | 93.5 | 5 | 0.5 | 1 | 45 | 156 |
| 57 | 88.5 | 10 | 0.5 | 1 | 32 | 141 |
| 58 | 97.98 | 1 | 0.02 | 1 | 24 | 186 |
| 59 | 97.95 | 1 | 0.05 | 1 | 46 | 172 |
| 60 | 93 | 1 | 5 | 1 | 45 | 174 |
| 61 | 88 | 1 | 10 | 1 | 27 | 204 |
| 62 | 98.45 | 1 | 0.5 | 0.05 | 30 | 148 |
| 63 | 98.4 | 1 | 0.5 | 0.1 | 47 | 158 |
| 64 | 78.5 | 1 | 0.5 | 20 | 46 | 277 |
| 65 | 68.5 | 1 | 0.5 | 30 | 27 | 438 |

Table 6

| Sample | Composition (mol %) ZnO | M | MO | R | $R_2O_3$ | CoO | α-Value | C-Value (at 1mA) |
|---|---|---|---|---|---|---|---|---|
| 66 | 97.5 | Ba | 1 | Pr | 0.5 | 1 | 60 | 198 |
| 67 | 97.5 | Ba | 1 | Tb | 0.5 | 1 | 58 | 324 |
| 68 | 97.5 | Ba | 1 | Dy | 0.5 | 1 | 59 | 348 |
| 69 | 97.5 | Ba | 1 | Ho | 0.5 | 1 | 58 | 368 |
| 70 | 97.5 | Ba | 1 | Er | 0.5 | 1 | 57 | 387 |
| 71 | 97.5 | Ba | 1 | Tm | 0.5 | 1 | 57 | 409 |
| 72 | 97.5 | Ba | 1 | Yb | 0.5 | 1 | 55 | 425 |
| 73 | 97.5 | Ba | 1 | Lu | 0.5 | 1 | 56 | 451 |
| 74 | 97.5 | Ba | 1 | Nd<br>Ga | 0.3<br>0.2 | 1 | 59 | 254 |
| 75 | 97.5 | Ba | 1 | Nd<br>Sm<br>Eu | 0.2<br>0.2<br>0.1 | 1 | 60 | 249 |
| 76 | 97.3 | Ca<br>Sr<br>Ba | 0.4<br>0.4<br>0.4 | Nd | 0.5 | 1 | 59 | 288 |

Table 7

| Sample | Composition (mol %) ZnO | $Nd_2O_3$ | BaO | CoO | $SiO_2$ | $SiO_2$ CoO | α | C-Value (at 1mA) | ΔC/C (%) |
|---|---|---|---|---|---|---|---|---|---|
| 77 | 88.82 | 0.03 | 1 | 10.1 | 0.05 | 0.005 | 35 | 170 | −11.5 |
| 78 | 88.80 | 0.05 | 1 | 10.1 | 0.05 | 0.005 | 61 | 189 | −2.2 |
| 79 | 88.35 | 0.5 | 1 | 10.1 | 0.05 | 0.005 | 82 | 201 | −0.5 |
| 80 | 86.88 | 2 | 1 | 10.1 | 0.02 | 0.002 | 67 | 230 | −2.0 |
| 81 | 83.88 | 5 | 1 | 10.1 | 0.02 | 0.002 | 52 | 225 | −5.0 |
| 82 | 81.88 | 7 | 1 | 10.1 | 0.02 | 0.002 | 36 | 398 | −14.1 |
| 83 | 89.30 | 0.5 | 0.05 | 10.1 | 0.05 | 0.005 | 34 | 385 | −11.2 |
| 84 | 89.25 | 0.5 | 0.1 | 10.1 | 0.05 | 0.005 | 53 | 189 | −4.8 |
| 85 | 88.85 | 0.5 | 0.5 | 10.1 | 0.05 | 0.005 | 67 | 211 | −1.7 |
| 86 | 87.35 | 0.5 | 2 | 10.1 | 0.05 | 0.005 | 71 | 198 | −1.8 |
| 87 | 84.35 | 0.5 | 5 | 10.1 | 0.05 | 0.005 | 51 | 175 | −4.6 |
| 88 | 82.35 | 0.5 | 7 | 10.1 | 0.05 | 0.005 | 34 | 169 | −13.7 |
| 89 | 98.445 | 0.5 | 1 | 0.05 | 0.005 | 0.1 | 32 | 162 | −11.5 |
| 90 | 98.39 | 0.5 | 1 | 0.1 | 0.01 | 0.1 | 51 | 177 | −5.1 |
| 91 | 98.29 | 0.5 | 1 | 0.2 | 0.01 | 0.1 | 68 | 195 | −1.9 |
| 92 | 97.48 | 0.5 | 1 | 1 | 0.02 | 0.02 | 77 | 199 | −0.9 |
| 93 | 83.30 | 0.5 | 1 | 15 | 0.2 | 0.013 | 63 | 258 | −2.3 |
| 94 | 77.50 | 0.5 | 1 | 20 | 1 | 0.05 | 52 | 309 | −4.9 |
| 95 | 72.50 | 0.5 | 1 | 25 | 1 | 0.04 | 36 | 427 | −14.8 |

Table 8

| Sample | Composition (mol %) ZnO | $Gd_2O_3$ | SrO | CoO | $TiO_2$ | $TiO_2$ / CoO | α | C-Value (at 1MA) | ΔC/C (%) |
|---|---|---|---|---|---|---|---|---|---|
| 96 | 87.85 | 0.05 | 1 | 11 | 0.1 | 0.009 | 62 | 219 | −2.3 |
| 97 | 87.40 | 0.5 | 1 | 11 | 0.1 | 0.009 | 81 | 211 | −0.6 |
| 98 | 85.90 | 2 | 1 | 11 | 0.1 | 0.009 | 70 | 198 | −1.9 |
| 99 | 82.90 | 5 | 1 | 11 | 0.1 | 0.009 | 53 | 253 | −4.7 |
| 100 | 88.30 | 0.5 | 0.1 | 11 | 0.1 | 0.009 | 55 | 287 | −4.6 |
| 101 | 87.90 | 0.5 | 0.5 | 11 | 0.1 | 0.009 | 69 | 208 | −1.8 |
| 102 | 86.40 | 0.5 | 2 | 11 | 0.1 | 0.009 | 70 | 195 | −1.9 |
| 103 | 83.40 | 0.5 | 5 | 11 | 0.1 | 0.009 | 51 | 243 | −4.7 |
| 104 | 98.39 | 0.5 | 1 | 0.1 | 0.01 | 0.1 | 52 | 172 | −4.8 |
| 105 | 98.29 | 0.5 | 1 | 0.2 | 0.01 | 0.05 | 68 | 185 | −2.0 |
| 106 | 97.48 | 0.5 | 1 | 1 | 0.02 | 0.02 | 78 | 195 | −1.1 |
| 107 | 83.30 | 0.5 | 1 | 15 | 0.2 | 0.013 | 72 | 208 | −2.2 |
| 108 | 77.50 | 0.5 | 1 | 20 | 1 | 0.05 | 50 | 293 | −5.0 |

Table 9

| Sample | Composition (mol %) ZnO | $Sm_2O_3$ | CaO | CoO | $CeO_2$ | $CeO_2$ / CoO | α | C-Value (at 1MA) | ΔC/C (%) |
|---|---|---|---|---|---|---|---|---|---|
| 109 | 87.85 | 0.05 | 1 | 11 | 0.1 | 0.009 | 60 | 228 | −2.7 |
| 110 | 87.40 | 0.5 | 1 | 11 | 0.1 | 0.009 | 75 | 195 | −0.6 |
| 111 | 85.90 | 2 | 1 | 11 | 0.1 | 0.009 | 69 | 208 | −2.0 |
| 112 | 82.90 | 5 | 1 | 11 | 0.1 | 0.009 | 53 | 262 | −4.5 |
| 113 | 88.30 | 0.5 | 0.1 | 11 | 0.1 | 0.009 | 52 | 289 | −4.8 |
| 114 | 87.90 | 0.5 | 0.5 | 11 | 0.1 | 0.009 | 71 | 215 | −1.9 |
| 115 | 86.40 | 0.5 | 2 | 11 | 0.1 | 0.009 | 73 | 206 | −2.0 |
| 116 | 83.40 | 0.5 | 5 | 11 | 0.1 | 0.009 | 50 | 249 | −4.9 |
| 117 | 98.39 | 0.9 | 1 | 0.1 | 0.01 | 0.1 | 52 | 185 | −5.1 |
| 118 | 98.29 | 0.5 | 1 | 0.2 | 0.01 | 0.05 | 63 | 197 | −2.3 |
| 119 | 97.48 | 0.5 | 1 | 1 | 0.02 | 0.02 | 75 | 199 | −1.4 |
| 120 | 83.30 | 0.5 | 1 | 15 | 0.2 | 0.013 | 69 | 205 | −2.0 |
| 121 | 77.50 | 0.5 | 1 | 20 | 1 | 0.05 | 51 | 301 | −5.1 |

Table 10

| Sample | Composition (mol %) ZnO | $Nd_2O_3$ | BaO | CoO | M' | $M'O_2$ | α | C-Value (at 1mA) | ΔC/C (%) |
|---|---|---|---|---|---|---|---|---|---|
| 122 | 97.48 | 0.5 | 1 | 1 | Zr | 0.02 | 73 | 183 | −0.9 |
| 123 | 88.30 | 0.5 | 1 | 10.1 | Zr | 0.1 | 79 | 196 | −0.6 |
| 124 | 97.48 | 0.5 | 1 | 1 | Hf | 0.02 | 72 | 176 | −1.3 |
| 125 | 88.30 | 0.5 | 1 | 10.1 | Hf | 0.1 | 82 | 190 | −1.0 |
| 126 | 97.48 | 0.5 | 1 | 1 | Ge | 0.02 | 70 | 185 | −1.2 |
| 127 | 88.30 | 0.5 | 1 | 10.1 | Ge | 0.1 | 78 | 198 | −1.0 |
| 128 | 97.48 | 0.5 | 1 | 1 | Sn | 0.02 | 75 | 189 | −1.1 |
| 129 | 88.30 | 0.5 | 1 | 10.1 | Sn | 0.1 | 79 | 200 | −0.6 |
| 130 | 97.50 | 0.5 | 1 | 1 | / | 0 | 60 | 220 | −12.5 |
| 131 | 88.40 | 0.5 | 1 | 10.1 | / | 0 | 52 | 178 | −19.4 |

Table 11

| Sample | Composition (mol %) ZnO | R | $R_2O_3$ | SrO | CoO | $TiO_2$ | α | C-Value (at 1mA) | ΔC/C (%) |
|---|---|---|---|---|---|---|---|---|---|
| 132 | 87.40 | La | 0.5 | 1 | 11 | 0.1 | 68 | 158 | −1.9 |
| 133 | 87.40 | Pr | 0.5 | 1 | 11 | 0.1 | 70 | 165 | −1.4 |
| 134 | 87.40 | Eu | 0.5 | 1 | 11 | 0.1 | 82 | 181 | −0.5 |
| 135 | 87.40 | Tb | 0.5 | 1 | 11 | 0.1 | 71 | 186 | −1.5 |
| 136 | 87.40 | Dy | 0.5 | 1 | 11 | 0.1 | 80 | 189 | −1.1 |
| 137 | 87.40 | Ho | 0.5 | 1 | 11 | 0.1 | 74 | 190 | −1.3 |
| 138 | 87.40 | Er | 0.5 | 1 | 11 | 0.1 | 72 | 188 | −1.3 |
| 139 | 87.40 | Yb | 0.5 | 1 | 11 | 0.1 | 70 | 190 | −1.1 |
| 140 | 87.40 | Lu | 0.5 | 1 | 11 | 0.1 | 71 | 198 | −1.5 |

Table 12

| Sample | Composition (mol %) ZnO | R | $R_2O_3$ | MO | CoO | $M'O_2$ | α | C-Value (at 1mA) | ΔC/C (%) |
|---|---|---|---|---|---|---|---|---|---|
| 141 | 87.30 | La<br>Pr<br>Nd | 0.2<br>0.2<br>0.2 | 1 | 11 | 0.1 | 72 | 175 | −1.3 |

Table 12-continued

| Sample | Composition (mol %) ZnO | R | $R_2O_3$ | MO | CoO | $M'O_2$ | α | C-Value (at 1mA) | ΔC/C (%) |
|---|---|---|---|---|---|---|---|---|---|
| 142 | 87.30 | Sm<br>Tb<br>Dy | 0.2<br>0.2<br>0.2 | 1 | 11 | 0.1 | 81 | 189 | −0.6 |
| 143 | 87.30 | Eu<br>Gd<br>Lu | 0.2<br>0.2<br>0.2 | 1 | 11 | 0.1 | 73 | 196 | −0.6 |

MO: mixtured of BaO, SrO and CaO at ratios of 1:1:1
$M'O_2$: mixture of $SiO_2$, $TiO_2$ and $CeO_2$ at ratios of 1:1:1.

Table 13

| Sample | Composition (mol %) ZnO | $Nd_2O_3$ | BaO | CoO | $Al_2O_3$ | $Al_2O_3$/CoO | α | C-Value (at 1mA) | ΔC/C (%) |
|---|---|---|---|---|---|---|---|---|---|
| 144 | 88.82 | 0.03 | 1 | 10.1 | 0.05 | 0.005 | 37 | 175 | −10.5 |
| 145 | 88.80 | 0.05 | 1 | 10.1 | 0.05 | 0.005 | 65 | 191 | −2.1 |
| 146 | 88.35 | 0.5 | 1 | 10.1 | 0.05 | 0.005 | 84 | 203 | −0.4 |
| 147 | 86.88 | 2 | 1 | 10.1 | 0.02 | 0.002 | 70 | 232 | −1.8 |
| 148 | 83.88 | 5 | 1 | 10.1 | 0.02 | 0.002 | 54 | 228 | −4.9 |
| 149 | 81.88 | 7 | 1 | 10.1 | 0.02 | 0.002 | 39 | 404 | −13.7 |
| 150 | 89.30 | 0.5 | 0.05 | 10.1 | 0.05 | 0.005 | 37 | 396 | −10.2 |
| 151 | 89.25 | 0.5 | 0.1 | 10.1 | 0.05 | 0.005 | 55 | 195 | −4.6 |
| 152 | 88.85 | 0.5 | 0.5 | 10.1 | 0.05 | 0.005 | 68 | 213 | −1.6 |
| 153 | 87.35 | 0.5 | 2 | 10.1 | 0.05 | 0.005 | 72 | 201 | −1.8 |
| 154 | 84.35 | 0.5 | 5 | 10.1 | 0.05 | 0.005 | 52 | 182 | −4.5 |
| 155 | 82.35 | 0.5 | 7 | 10.1 | 0.05 | 0.005 | 36 | 174 | −13.4 |
| 156 | 98.445 | 0.5 | 1 | 0.05 | 0.005 | 0.1 | 34 | 168 | −11.3 |
| 157 | 98.39 | 0.5 | 1 | 0.1 | 0.01 | 0.1 | 53 | 179 | −4.9 |
| 158 | 98.29 | 0.5 | 1 | 0.2 | 0.01 | 0.1 | 69 | 198 | −1.8 |
| 159 | 97.48 | 0.5 | 1 | 1 | 0.02 | 0.02 | 78 | 203 | −0.9 |
| 160 | 83.30 | 0.5 | 1 | 15 | 0.2 | 0.013 | 65 | 262 | −2.1 |
| 161 | 77.50 | 0.5 | 1 | 20 | 1 | 0.05 | 52 | 318 | −4.7 |
| 162 | 72.50 | 0.5 | 1 | 25 | 1 | 0.04 | 38 | 435 | −14.0 |

Table 14

| Sample | Composition (mol %) ZnO | $Gd_2O_3$ | SrO | CoO | $Ga_2O_3$ | $Ga_2O_3$/CoO | α | C-Value (at 1mA) | ΔC/C (%) |
|---|---|---|---|---|---|---|---|---|---|
| 163 | 87.85 | 0.05 | 1 | 11 | 0.1 | 0.009 | 64 | 221 | −2.4 |
| 164 | 87.40 | 0.5 | 1 | 11 | 0.1 | 0.009 | 80 | 215 | −0.5 |
| 165 | 85.90 | 2 | 1 | 11 | 0.1 | 0.009 | 72 | 203 | −1.8 |
| 166 | 82.90 | 5 | 1 | 11 | 0.1 | 0.009 | 54 | 256 | −4.5 |
| 167 | 88.30 | 0.5 | 0.1 | 11 | 0.1 | 0.009 | 56 | 289 | −4.8 |
| 168 | 87.90 | 0.5 | 0.5 | 11 | 0.1 | 0.009 | 71 | 212 | −1.9 |
| 169 | 86.40 | 0.5 | 2 | 11 | 0.1 | 0.009 | 73 | 198 | −2.0 |
| 170 | 83.40 | 0.5 | 5 | 11 | 0.1 | 0.009 | 53 | 245 | −4.7 |
| 171 | 98.39 | 0.5 | 1 | 0.1 | 0.01 | 0.1 | 54 | 175 | −4.9 |
| 172 | 98.29 | 0.5 | 1 | 0.2 | 0.01 | 0.05 | 68 | 188 | −1.8 |
| 173 | 97.48 | 0.5 | 1 | 1 | 0.02 | 0.02 | 77 | 196 | −1.0 |
| 174 | 83.30 | 0.5 | 1 | 15 | 0.2 | 0.013 | 73 | 212 | −2.0 |
| 175 | 77.50 | 0.5 | 1 | 20 | 1 | 0.05 | 51 | 297 | −5.1 |

Table 15

| Sample | Composition (mol %) ZnO | $Sm_2O_3$ | CaO | CoO | $In_2O_3$ | $In_2O_3$/CoO | α | C-Value (at 1mA) | ΔC/C (%) |
|---|---|---|---|---|---|---|---|---|---|
| 176 | 87.85 | 0.05 | 1 | 11 | 0.1 | 0.009 | 62 | 232 | −2.6 |
| 177 | 87.40 | 0.5 | 1 | 11 | 0.1 | 0.009 | 78 | 198 | −0.7 |
| 178 | 85.90 | 2 | 1 | 11 | 0.1 | 0.009 | 71 | 211 | −1.9 |
| 179 | 82.90 | 5 | 1 | 11 | 0.1 | 0.009 | 52 | 264 | −4.3 |
| 180 | 88.30 | 0.5 | 0.1 | 11 | 0.1 | 0.009 | 53 | 291 | −4.9 |
| 181 | 87.90 | 0.5 | 0.5 | 11 | 0.1 | 0.009 | 70 | 221 | −1.8 |
| 182 | 86.40 | 0.5 | 2 | 11 | 0.1 | 0.009 | 72 | 208 | −2.1 |
| 183 | 83.40 | 0.5 | 5 | 11 | 0.1 | 0.009 | 51 | 253 | −4.7 |
| 184 | 98.39 | 0.5 | 1 | 0.1 | 0.01 | 0.1 | 53 | 186 | −5.1 |
| 185 | 98.29 | 0.5 | 1 | 0.2 | 0.01 | 0.05 | 65 | 198 | −2.2 |
| 186 | 97.48 | 0.5 | 1 | 1 | 0.02 | 0.02 | 74 | 205 | −1.2 |
| 187 | 83.30 | 0.5 | 1 | 15 | 0.2 | 0.013 | 71 | 209 | −1.9 |
| 188 | 77.50 | 0.5 | 1 | 20 | 1 | 0.05 | 50 | 304 | −5.2 |

Table 16

| Sample | Composition (mol %) ZnO | $Nd_2O_3$ | BaO | CoO | M" | $M''_2O_3$ | α | C-Value (at 1mA) | ΔC/C (%) |
|---|---|---|---|---|---|---|---|---|---|
| 189 | 97.48 | 0.5 | 1 | 1 | B | 0.02 | 75 | 186 | −1.5 |
| 190 | 88.30 | 0.5 | 1 | 10.1 | B | 0.1 | 82 | 195 | −1.3 |
| 191 | 97.48 | 0.5 | 1 | 1 | Cr | 0.02 | 73 | 178 | −0.8 |
| 192 | 88.30 | 0.5 | 1 | 10.1 | Cr | 0.1 | 83 | 189 | −0.4 |
| 193 | 97.48 | 0.5 | 1 | 1 | Fe | 0.02 | 71 | 187 | −1.3 |
| 194 | 88.30 | 0.4 | 1 | 10.1 | Fe | 0.1 | 75 | 196 | −0.9 |
| 195 | 97.48 | 0.5 | 1 | 1 | Y | 0.02 | 76 | 191 | −1.0 |
| 196 | 88.30 | 0.5 | 1 | 10.1 | Y | 0.1 | 80 | 203 | −0.5 |
| 197 | 97.48 | 0.5 | 1 | 1 | Sb | 0.02 | 76 | 189 | −1.3 |
| 198 | 88.30 | 0.5 | 1 | 10.1 | Sb | 0.1 | 82 | 197 | −0.7 |
| 199 | 97.50 | 0.5 | 1 | 1 | / | 0 | 60 | 220 | −12.5 |
| 200 | 88.40 | 0.5 | 1 | 10.1 | / | 0 | 52 | 178 | −19.4 |

Table 17

| Sample | Composition (mol %) ZnO | R | $R_2O_3$ | SrO | CoO | $Ga_2O_3$ | α | C-Value cat 1mA) | ΔC/C ClC (%) |
|---|---|---|---|---|---|---|---|---|---|
| 201 | 87.40 | La | 0.5 | 1 | 11 | 0.1 | 70 | 165 | −1.8 |
| 202 | 87.40 | Pr | 0.5 | 1 | 11 | 0.1 | 76 | 172 | −1.5 |
| 203 | 87.40 | Eu | 0.5 | 1 | 11 | 0.1 | 85 | 185 | −0.4 |
| 204 | 87.40 | Tb | 0.5 | 1 | 11 | 0.1 | 74 | 188 | −1.4 |
| 205 | 87.40 | Dy | 0.5 | 1 | 11 | 0.1 | 82 | 191 | −0.9 |
| 206 | 87.40 | Ho | 0.5 | 1 | 11 | 0.1 | 76 | 193 | −1.2 |
| 207 | 87.40 | Er | 0.5 | 1 | 11 | 0.1 | 74 | 192 | −1.3 |
| 208 | 87.40 | Yb | 0.5 | 1 | 11 | 0.1 | 76 | 191 | −1.1 |
| 209 | 87.40 | Lu | 0.5 | 1 | 11 | 0.1 | 72 | 202 | −1.4 |

Table 18

| Sample | Composition (mol %) ZnO | R | $R_2O_3$ | MO | CoO | $M''_2O_3$ | α | C-Value (at 1mA) | ΔC/C (%) |
|---|---|---|---|---|---|---|---|---|---|
| 210 | 87.30 | La | 0.2 | 1 | 11 | 0.1 | 75 | 178 | −1.2 |
| | | Pr | 0.2 | | | | | | |
| | | Nd | 0.2 | | | | | | |
| 211 | 87.30 | Sm | 0.2 | 1 | 11 | 0.1 | 84 | 195 | −0.6 |
| | | Tb | 0.2 | | | | | | |
| | | Dy | 0.2 | | | | | | |
| 212 | 87.30 | Eu | 0.2 | 1 | 11 | 0.1 | 76 | 198 | −0.5 |
| | | Gd | 0.2 | | | | | | |
| | | Lu | 0.2 | | | | | | |

MO: mixture of BaO, SrO and CaO at ratios of 1:1:1
$M''_2O_3$: mixture of $Al_2O_3$, $Cr_2O_3$ and $Ga_2O_3$ at ratios of 1:1:1

As shown in Tables 1 to 6, the ceramic compositions having 0.01 to 10 mole % of $R_2O_3$, 0.01 to 10 mole % of MO and 0.05 to 30 mole % of CoO imparted remarkably high α-value and someones imparted higher than 60 of the α-value though certain differences are found depending upon the kinds of the rare earth oxide and the alkaline earth metal oxide.

These characteristics can be attained by combining the components of zinc oxide, the rare earth oxide, cobalt oxide and the alkaline earth metal oxide.

The sintered body of the zinc oxide is the n-type semiconductor having relatively low resistance. It was observed that the thin insulation layer of main components of the rare earth oxide, the alkaline earth oxide and cobalt oxide was formed at the boundary of the grains of the zinc oxide crystals. It is considered that the insulation layer imparts the potential barrier to the current whereby excellent non-linearity of the sintered body can be attained. Accordingly, the excellent non-linearity can not be attained when one of the rare earth oxide, the alkaline earth metal oxide and cobalt oxide is not combined.

The excellent α-value can be obtained by the composition comprising 99.93 to 50 mole % as ZnO; 0.01 to 10 mole % as $R_2O_3$; 0.01 to 10 mole % as MO; and 0.05 to 30 mole % as CoO. The α-value is too low when the $R_2O_3$ component is less than 0.01 mole %; the MO component is less than 0.01 mole %; or the CoO component is less than 0.05 mole %. The α-value is also too low when the $R_2O_3$ component is more than 10 mole %; the MO component is more than 10 mole %; the CoO component is more than 30 mole %.

As shown in Table 7 to 12, the ceramic compositions comprising 99.74 to 69 mole % of zinc oxide as ZnO, 0.05 to 5 mole % of the specific rare earth oxide as $R_2O_3$ and 0.1 to 5 mole % of the alkaline earth metal oxide as MO 0.1 to 20 mole % of cobalt oxide as CoO and 0.01 to 1 mole of the tetravalent element oxide as $M'O_2$ imparted high α-value as higher than 50 and someone imparted higher than 80 of the α-value and moreover, they imparted the high temperature load life characteristic.

The ceramic compositions comprising 99.24 to 80.8 mole % of zinc oxide as ZnO, 0.05 to 2 mole % of the rare earth oxide as $R_2O_3$, 0.5 to 2 mole % of the alkaline earth metal oxide as MO, 0.2 to 15 mole % of cobalt oxide as CoO and 0.01 to 0.2 mole % of the tetravalent element oxide as $M'O_2$ imparted especially high α-value as higher than 60 and they also imparted high temperature load life characteristic.

The effects of the combination of the tetravalent element oxide for the non-linearity and the life characteristic are remarkable. The molar ratio of $M'O_2$/CoO is in the range of 0.002 to 0.1.

The characteristics can be attained by combining the components of zinc oxide, the rare earth oxide, cobalt oxide, the alkaline earth metal oxide and the tetravalent element oxide.

The α-value is low and the life characteristic is low when the $R_2O_3$ component is less than 0.05 mole %, the MO component is less than 0.1 mole %, the CoO component is less than 0.1 mole %, or the $M'O_2$ component is less than 0.1 mole %. The α-value is also low and the life characteristic is low when the $R_2O_3$ component is more than 5 mole %, the MO component is more than 5 mole %, the CoO component is more than 20 mole % or the $M'O_2$ component is more than 1 mole %.

As shown in Table 13 to 18, the ceramic compositions comprising 99.74 to 69 mole % of zinc oxide as ZnO, 0.05 to 5 mole % of the rare earth oxide as $R_2O_3$, 0.1 to 5 mole % of the alkaline earth metal oxide as MO, 0.1 to 20 mole % of cobalt oxide as CoO and 0.01 to 1 mole % of the trivalent element oxide as $M''_2O_3$ imparted high α-value such as higher than 50 and someone imparted higher than 80 of the α-value and moreover, they imparted the high temperature load life characteristic.

The ceramic compositions comprising 99.24 to 80.8 mole % as ZnO, 0.05 to 2 mole % as $R_2O_3$, 0.5 to 2 mole % as MO, 0.2 to 15 mole % as CoO, and 0.01 to 0.2 mole % as $M''_2O_3$ imparted especially high α-value as higher than 60 and they also imparted high temperature load life characteristic.

The effects of the combination of the trivalent element oxide for the non-linearity and the life characteristic are remarkable.

The molar ratio of $M''_2O_3$/CoO in the range of 0.002 to 0.1.

The characteristics can be attained by combining the components of zinc oxide, the rare earth oxide, cobalt oxide, the alkaline earth metal oxide and the tetravalent element oxide.

The α-value is low and the life characteristic is low when the $R_2O_3$ component is less than 0.05 mole %, the MO component is less than 0.1 mole %, the CoO component is less than 0.1 mole %, or the $M''_2O_3$ component is less than 0.01 mole %.

The α-value is also low and the life characteristic is low when the $R_2O_3$ component is more than 5 mole %, the MO component is more than 5 mole %, the CoO component is more than 20 mole % or the $M'_2O_3$ component is more than 1 mole %.

As described above, the varistors having the composition defined above, have excellent non-linearity and can be used for the purposes of circuit voltage stabilization instead of a constant voltage Zener diode as well as for the purpose of surge absorption and suppression of abnormal voltage.

It is difficult to pass a large current through a Zener diode. However, it is possible to pass a large current through the varistor of the present invention by increasing the electrode area i.e. the area of the varistor.

In principle, the C-value for a varistor whose non-linearity is based on the sintered body itself can be increased by increasing a thickness of the varistor in the direction passing a current. On the other hand, the C-value of the sintered body is higher, the thickness thereof can be thinner to decrease the size of the sintered body for passing a desired current.

The varistors of the present invention can have a wide range of the C-value by selecting the components in the composition and sintering conditions. The non-linearity of the varistor is especially remarkable in a range of the C-value of 160 to 450 volts per 1 mm of thickness.

The varistors of the present invention are superior to the conventional zinc oxide type varistor containing bismuth which has the C-value of 100 to 300 volts. Accordingly, the varistors of the present invention can be expected to impart special characteristics as a high voltage varistors for a color TV and an electronic oven, etc.

The components of the ceramic composition of the present invention are zinc oxide, the specific rare earth oxide, the specific alkaline earth oxide, cobalt oxide and the trivalent element oxide or the tetravalent element oxide and they do not include a volatile component which is vaporizable in the sintering operation such as bismuth. Accordingly, the process for preparing the ceramic compositions is easy and the fluctuation of the characteristics of the varistors is small to give excellent reproductivity.

It is easy to prepare them in a mass production in high yield and therefore, the cost is low. Accordingly, there are significant advantages in the practical process.

What is claimed is:

1. A non-linear resistor devoid of bismuth oxide and having a high value and high load life stability comprising a sintered body of a ceramic composition, which comprises: 99.93 to 50 mole % of zinc oxide as ZnO; 0.01 to 10 mole % of a specific rare earth oxide selected from the group consisting of oxides of lanthanum, praseodymium, neodymium, samarium, europium, gadolinium, terbium, dysprosium, holmium, erbium, thulium, ytterbium and lutetium as $R_2O_3$; 0.01 to 10 mole % of an alkaline earth oxide selected from the group consisting of oxides of calcium, strontium and barium as MO; 0.05 to 30 mole % of cobalt oxide as CoO and 0.01 to 1 mole % of a specific tetravalent element oxide $M'O_2$ selected from the group consisting of oxides of silicon, germanium, tin, titanium, zirconium, hafnium and cerium.

2. The non-linear resistor according to claim 1 wherein the ceramic composition comprises 99.74 to 69 mole % of the ZnO component, 0.05 to 5 mole % of the $R_2O_3$ component, 0.1 to 5 mole % of the MO component, 0.1 to 20 mole % of the CoO component, and 0.01 to 1 mole % of the $M'O_2$ component.

3. The non-linear resistor according to claim 1 wherein the ceramic composition comprises 99.24 to 80.8 mole % of the ZnO component, 0.05 to 2 mole % of the $R_2O_3$ component, 0.5 to 2 mole % of the MO component, 0.2 to 15 mole % of the CoO component and 0.01 to 0.2 mole % of the $M'O_2$ component.

4. A non-linear resistor devoid of bismuth oxide and having a high value and high load life stability comprising a sintered body of a ceramic composition, which comprises: 99.93 to 50 mole % of zinc oxide as ZnO; 0.01 to 10 mole % of a specific rare earth oxide $R_2O_3$ selected from the group consisting of oxides of lanthanum, praseodymium, neodymium, samarium, europium, gadolinium, terbium, dysprosium, holmium, erbium, thulium, ytterbium and lutetium; 0.01 to 10 mole % of an alkaline earth metal oxide MO selected from the group consisting of oxides of calcium, strontium and barium; 0.05 to 30 mole % of cobalt oxide as CoO and 0.01 to 1 mole % of a specific trivalent element oxide $M''_2O_3$ selected from the group consisting of oxides of boron, aluminum, gallium, indium, yttrium, chromium, iron and antimony.

5. The non-linear resistor according to claim 4 wherein the ceramic composition comprises 99.74 to 69 mole % of the ZnO component, 0.05 to 5 mole % of the $R_2O_3$ component, 0.1 to 5 mole % of MO component, 0.1 to 20 mole % of the CoO component and 0.01 to 1 mole % of the $M''_2O_3$ component.

6. The non-linear resistor according to claim 4 wherein the ceramic composition comprises 99.24 to 80.8 mole % of the ZnO component, 0.05 to 2 mole % of the $R_2O_3$ component, 0.5 to 2 mole % of the MO component, 0.2 to 15 mole % of the CoO component and 0.01 to 0.2 mole % of the $M''_2O_3$ component.

* * * * *